US012781477B2

(12) United States Patent
Gorman et al.

(10) Patent No.: US 12,781,477 B2
(45) Date of Patent: Nov. 3, 2026

(54) SITE PLANNING AND STAKEOUT USING MACHINE PERCEPTION

(71) Applicant: Caterpillar Inc., Peoria, IL (US)

(72) Inventors: Corey Lee Gorman, Peoria, IL (US); Roberto Martinez, Chicago, IL (US); Justin Steinlage, Mackinaw, IL (US); Russell Schloss, Pittsburgh, PA (US)

(73) Assignee: Caterpillar Inc., Peoria, IL (US)

( * ) Notice: Subject to any disclaimer, the term of this patent is extended or adjusted under 35 U.S.C. 154(b) by 218 days.

(21) Appl. No.: 18/637,936

(22) Filed: Apr. 17, 2024

(65) Prior Publication Data

US 2025/0327279 A1 Oct. 23, 2025

(51) Int. Cl.
*E02F 9/26* (2006.01)
*E02F 9/20* (2006.01)

(52) U.S. Cl.
CPC ..... *E02F 9/265* (2013.01); *E02F 9/2045* (2013.01)

(58) Field of Classification Search
CPC ..... E02F 9/265; E02F 9/2045; E02F 9/2054; E02F 9/262; G01C 15/06
See application file for complete search history.

(56) References Cited

U.S. PATENT DOCUMENTS 6,108,076 A 8/2000 Hanseder
6,112,143 A * 8/2000 Allen ..... E02F 3/842 701/445
6,330,503 B1 * 12/2001 Sharp ..... G05D 1/0274 404/93
10,235,774 B1 3/2019 Gitz et al.
10,504,231 B2 12/2019 Fiala
10,829,911 B2 11/2020 Kennedy et al.
11,158,127 B2 10/2021 Mitchell
11,210,519 B2 12/2021 Nichols
11,434,623 B2 9/2022 Hayakawa et al.
2001/0023766 A1 9/2001 Ohtomo et al.
2009/0256860 A1 * 10/2009 Nichols ..... G01S 19/40 345/632
2021/0284336 A1 * 9/2021 Muler ..... B64D 47/02
2022/0002970 A1 1/2022 Kurosawa

FOREIGN PATENT DOCUMENTS

EP 3670757 A1 6/2020

OTHER PUBLICATIONS

Written Opinion and International Search Report for Int'l. Patent Appln. No. PCT/US2025/019474, mailed Jun. 11, 2025 (14 pgs).
Olson, "AprilTag: A robust and flexible visual fiducial system", Available online @ http://april.eecs.umich.edu, 8 pages.

* cited by examiner

*Primary Examiner* — Russell Frejd

(57) ABSTRACT

A stakeout system is constructed to stakeout a worksite according to a site plan. The system includes a set of fiducial markers, each being associated with a corresponding construction operation performed at the worksite. A set of sensors having diverse sensory modalities generate respective signals from which information associated with the construction operation is conveyed. A processor is constructed to ascertain from the signals a location of a work machine at the worksite, as well as the corresponding construction operation performed thereat. The work machine is guided in performing the construction operation according to the location of the work machine in the site plan.

18 Claims, 5 Drawing Sheets

SITE PLANNING AND STAKEOUT USING MACHINE PERCEPTION

The present disclosure generally relates to machine perception techniques. More specifically, the disclosure is directed to machine perception as applied to construction site planning and stakeout.

BACKGROUND

In construction, a stakeout (also known as "staking out" or "setting out") refers to the process of marking the locations and boundaries of a proposed structure or infrastructure on the building site. This ensures that the construction work is carried out accurately according to the design plans and specifications. Staking out can be challenging due to several factors that affect the accuracy, efficiency, and overall success of the process. Staking out a construction site might be difficult in some cases. For example, projects with intricate designs, multiple levels, or irregular shapes can make staking out more challenging because they require a higher level of precision and attention to detail. This causes mental strain on the operator in understanding and interpreting the measurements provided via grade stakes, then translating them into accurate machine operation. Difficult terrain, poor visibility, or unfavorable weather conditions can make staking out more complicated in that surveyors may need to use specialized equipment or techniques to overcome these challenges. Additionally, as with any manual process, staking out is prone to human error, which can result from misread measurements, misinterpreted plans, or incorrectly placed markers. The accuracy and proper calibration of surveying equipment, such as theodolites and total stations, are crucial for successful staking out and inaccurate or poorly calibrated equipment can lead to errors in measurements and marker placement.

Techniques for assisting work machine operators in performing construction tasks include U.S. Pat. No. 10,829,911, which is directed to a visual assistance and control system for a work machine. The work machine includes a location sensor configured to generate a machine location sensor signal indicative of a location of the machine. The machine includes a communication component that communicates with a worksite server and retrieves object location data. The machine also includes virtual model generator logic that determines the object is within a field of view of an operator of the machine, based on the machine location sensor signal and object location data, and generates an augmentation indication indicative of the determination. The machine includes augmentation logic that generates and displays an augmented reality overlay, based on the augmentation indication, and displays an indication of the object proximate the object within the field of view of the operator.

Research and engineering resources continue to be expended towards assisting work machines in performing construction operations.

SUMMARY

In one aspect of the present inventive concept, a stakeout system is constructed to stakeout a worksite according to a site plan. The system includes a set of fiducial markers, each being associated with a corresponding construction operation performed at the worksite. A set of sensors having diverse sensory modalities generate respective signals from which information associated with the construction operation is conveyed. A processor is constructed to ascertain from the signals a location of a work machine at the worksite, as well as the corresponding construction operation performed thereat. The work machine is guided in performing the construction operation according to the location of the work machine in the site plan.

In another aspect, a stakeout apparatus is constructed to stakeout a worksite and includes a set of diverse sensors constructed to generate respective signals from which information associated with a construction operation is conveyed from fiducial markers distributed over the worksite. A processor is constructed to generate a site plan in which a selected location on the worksite is defined. The construction operations conveyed by the signals are interpolated from fiducial markers that bound the selected location on the worksite. The processor guides a work machine in performing the interpolated construction operation at the selected location.

In yet another aspect, a stakeout method of a worksite includes distributing a set of fiducial markers over the worksite according to a site plan. The fiducial markers are associated with respective construction operations performed at the worksite. A location of a work machine at the worksite is ascertained from signals generated by a set of diverse sensors responsive to the fiducial markers. The signals further include a corresponding construction operation from among the construction operations performed at the worksite. The work machine is guided in performing the construction operation at the location of the work machine in the site plan.

DESCRIPTION OF EXAMPLE EMBODIMENTS

Figure 1:
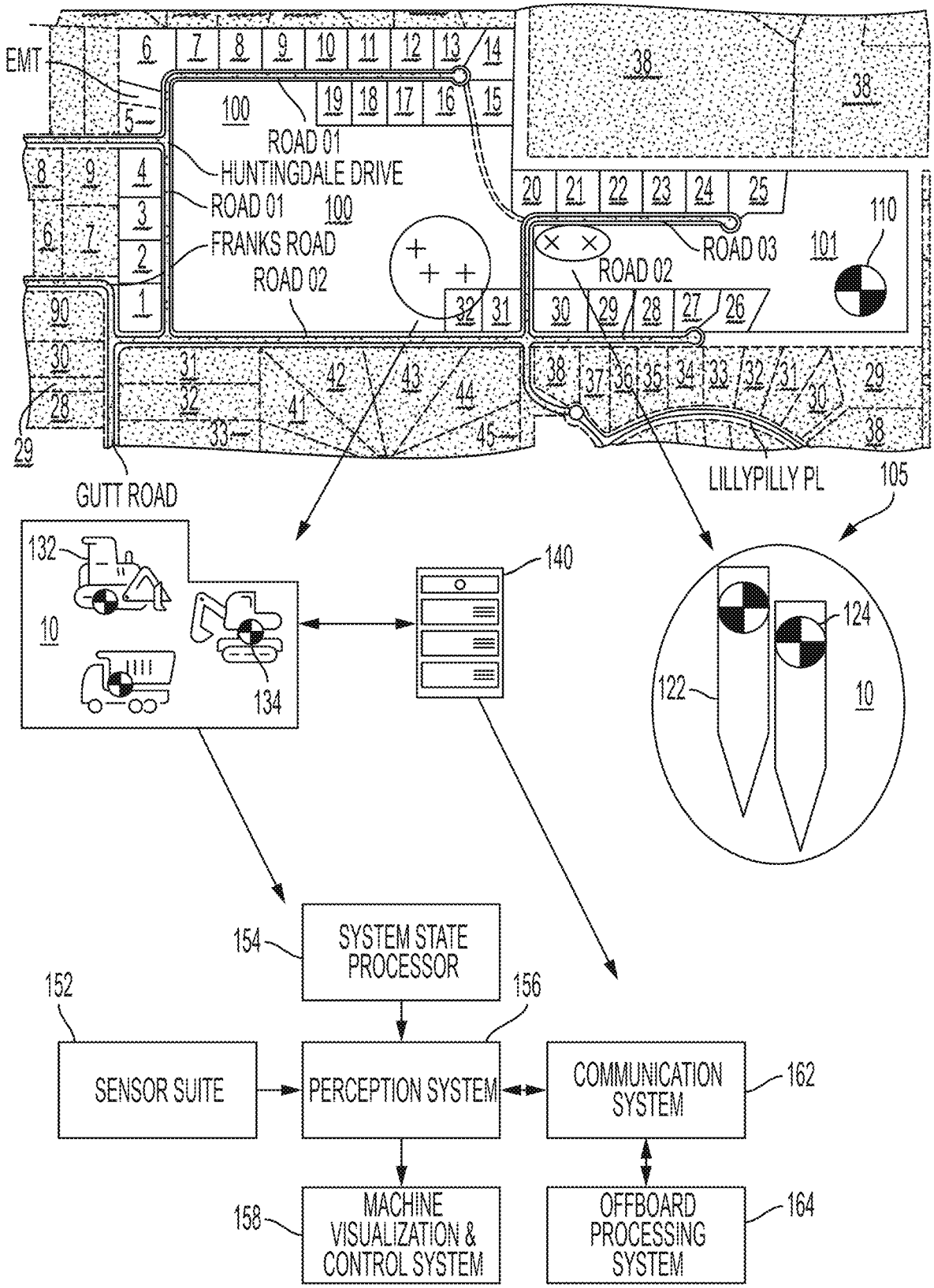
FIG. 1 is a diagram depicting an exemplary site stakeout technique by which the present inventive concept can be embodied.

The present inventive concept is best described through certain embodiments thereof, which are described in detail herein with reference to the accompanying drawings, wherein like reference numerals refer to like features throughout. It is to be understood that the term invention, when used herein, is intended to connote the inventive concept underlying the embodiments described below and not merely the embodiments themselves. It is to be understood further that the general inventive concept is not limited to the illustrative embodiments described below and the following descriptions should be read in such light.

Additionally, the word exemplary is used herein to mean, "serving as an example, instance or illustration." Any embodiment of construction, process, design, technique, etc., designated herein as exemplary is not necessarily to be construed as preferred or advantageous over other such embodiments.

The FIGURES described herein include schematic block diagrams illustrating various interoperating functional modules. Such diagrams are not intended to serve as electrical schematics and interconnections illustrated are intended to depict signal flow, various interoperations between functional components and/or processes and are not necessarily direct electrical connections between such components. Moreover, the functionality illustrated and described via separate components need not be distributed as shown, and the discrete blocks in the diagrams are not necessarily intended to depict discrete electrical components.

The techniques described herein are directed to machine perception in construction, e.g., site stakeout procedures. Upon review of this disclosure and appreciation of the concepts disclosed herein, the ordinarily skilled artisan will recognize other machine perception contexts in which the present inventive concept can be applied. The scope of the present invention is intended to encompass all such alternative implementations.

FIG. 1 is a diagram depicting an exemplary site stakeout system 105 by which the present inventive concept can be embodied. A site plan 100 defines the boundaries and internal structures of a worksite 10. Such structures may be realized using one or more work machines, representatively illustrated at work machine 132, according to site plan 100. Worksite 10 may be staked out according to site plan 100 through grade stakes, representatively illustrated at grade stake 122. Grade stakes 122 may be placed (e.g., driven into the ground) to inform work machine operators as to where the boundaries and internal structures are to be formed.

As illustrated in FIG. 1, grade stakes 122 may have attached thereon respective fiducial markers, representatively illustrated at fiducial marker 124. Similarly, work machines 132 may also have fiducial markers, representatively illustrated at fiducial marker 134, attached thereto. Another fiducial marker, e.g., fiducial marker 110, may provide a global (in absolute coordinates) or local reference (in coordinates relative to the fiducial marker). Metadata may be associated with the fiducial markers 124 and 134 that inform the work machines 132 of site design information relative to the fiducial marker's location. Some implementations of the present inventive concept may encode information on the fiducial marker itself. For example, embodiments of the present inventive concept may utilize AprilTags, developed by the University of Michigan and available in an open-source software package. AprilTags encode a lexicographical code, or lexicode thereon, that can be decoded by perception system 156 to derive therefrom construction information such as excavator cut, fill and slope operations. AprilTags can also convey its orientation within the relevant coordinate system (local vs. global) as well. Careful attachment of an AprilTag can indicate the orientation of the item to which it is applied, e.g., the pose of a work machine 132.

Sensor suite 152 may include sensors of diverse modalities for use by perception system 156 for machine perception. System state processor 154 may be constructed to evaluate sensor suite 152 as to what sensors are present in the suite and/or which are in operable order. Additionally, system state processor 152 may determine what features a machine operator has enabled to the extent that the perception processing is concerned.

Perception system 156 may be constructed or otherwise configured to receive sensor data from sensor suite 152, e.g., data from fiducial markers 124 and 134 taken through varied sensor modalities, combining sensor data across modalities, decoding lexicodes and formatting resulting perception data for use by machine visualization and control system 158. For example, the sensor data from each sensor may be presented to perception system 156 as a state vector and perception system 156 may implement a Kalman filter or a neural network. Perception data output by perception system 156, may include a marker type, e.g., excavation fill, cut, slope, etc., an index number that may identify a specific point in the site plan design, a location of the marker in either local or global reference frames, and a pose or orientation of fiducial markers 124 and 134.

Machine visualization and control system 158 may be constructed or otherwise configured to provide the machine operator with a view of the work tool during the construction operation indicated by a fiducial marker 124 or 134. Machine visualization and control system 158 may further control precision of the construction operation by automated mechanisms that are provided with the perception data described above. Machine visualization and control system 158 may provide construction operation information to the machine operator and my further constrain operator control functionality for purposes of precision in performing the associated construction operation.

Perception system 156 may rely on offboard data and processing by way of a worksite server 140 that implements an offboard processing system 164 that may, for example, realize a database which may be accessed by the relevant work machine through a communication system 162. Worksite server 140 may be located on worksite 10 or may be located remotely from worksite 10.

Figure 2:
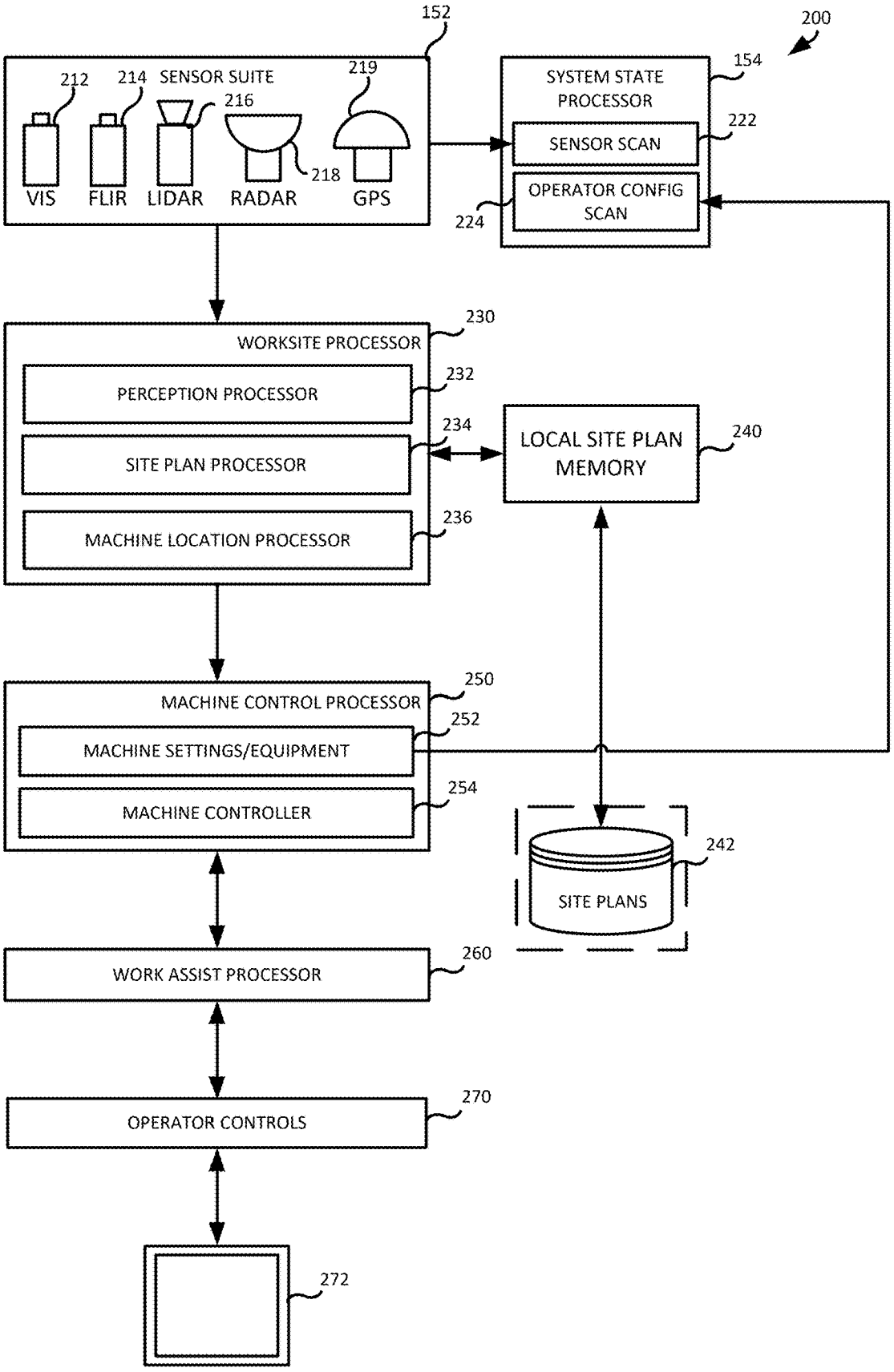
FIG. 2 is a schematic block diagram of an exemplary processing architecture by which the present inventive concept can be embodied.

FIG. 2 is a schematic block diagram of an exemplary stakeout apparatus 200 by which the present inventive concept can be embodied. As described above, sensor suite 152 may implement sensors of varied modalities, such as a visible spectrum camera 212, a forward-looking infrared camera (FLIR) 214, a lidar 216, a radar 218 and a GPS receiver 219. Visible spectrum camera 212 may be a smart camera that performs feature detection and tagging. FLIR camera 214 may capture images from the infrared spectrum and may provide site plan data obtained from fiducial markers that have high emissivity in the infrared spectrum. Lidar 216 may generate 3-dimensional point cloud data from which objects of interest may be recognized. Radar 218 may produce distance data and may be configured with Doppler mechanisms from which speed and direction of travel can be ascertained. GPS receiver 219 may provide absolute geolocation data.

Stakeout apparatus 200 may include worksite processor 230 that is constructed from processor circuitry to perform computation and data processing operations for deriving a local site plan, which may then be stored in local site plan memory 240. Alternatively or additionally, worksite processor 230 may obtain a global site plan from offboard site plan storage 242 from which a local site plan can be derived.

Perception processor 232 may be constructed to implement machine perception by which a work machine 132 may identify fiducial markers and retrieve therefrom information encoded thereon. Multiple sensor modalities of sensor suite 152 beneficially retrieves the information on multiple detection channels, e.g., visible, infrared, radio, etc., which increases the probability of correctly obtaining the position of and lexicode from the fiducial markers. That is, if only one sensor is used and environmental conditions are such as to extinguish a sensor probe in reading a fiducial marker, another sensor probe may be less susceptible to those environmental conditions. Perception processor 232 may accept multichannel sensor data in the form of a state vector that conforms to a Kalman filter, for example. The output of the Kalman filter may be an estimation of a site plan that can be used for machine localization. The present inventive concept can be practiced using other perception processing mechanisms, such as artificial intelligence (e.g., deep learning neural network).

Site plan processor 234 may be constructed to determine and/or construct a local site plan or alternatively, if local site plan memory 240 is sufficiently large, a global site plan of worksite 10 as a whole may be obtained from offboard site plan memory 242. Site plan processor 234 may accept output data from perception processor 232 and to generate site plan data that is sufficient to locate work machine 132 at the worksite 10. Exemplary techniques for site planning are provided below in FIGS. 3 and 4.

Machine location processor 236 may be constructed to accept site plan data from site plan processor 234 to localize work machine 132 on the worksite 10 according to fiducial markers 124 laid out according to site plan 100 stored in local site plan memory 240. Examples of machine localization are provided below.

System state processor 154 may include a sensor scan component 222 by which sensor suite 152 is analyzed for proper operation and for presence of the various sensors implemented therein. The number of operating sensors in sensor suite 152 may establish the size of the state vector, for example, presented to perception processor 232. System state processor 154 may further include an operator configuration scan component 224 by which machine settings/equipment 252 of machine control processor 250. Such information may be used to constrain work machine control for purposes of precision, machine-assisted construction operations.

Machine control processor 250 may include machine controller 254 by which control over work machine construction operations may be carried out. The present inventive concept may be embodied with different machine control techniques Machine controller 254 may guide the construction operations under direction of a work assist processor 260 that assists the operator in more precise construction operations, e.g., cutting, filling and slope regions, as discussed above. Work assist processor 260 may work with operator controls 270 that are limited or otherwise constrained in operation by work assist processor 260 and may indicate the controlled operations on a display 272.

Figure 3:
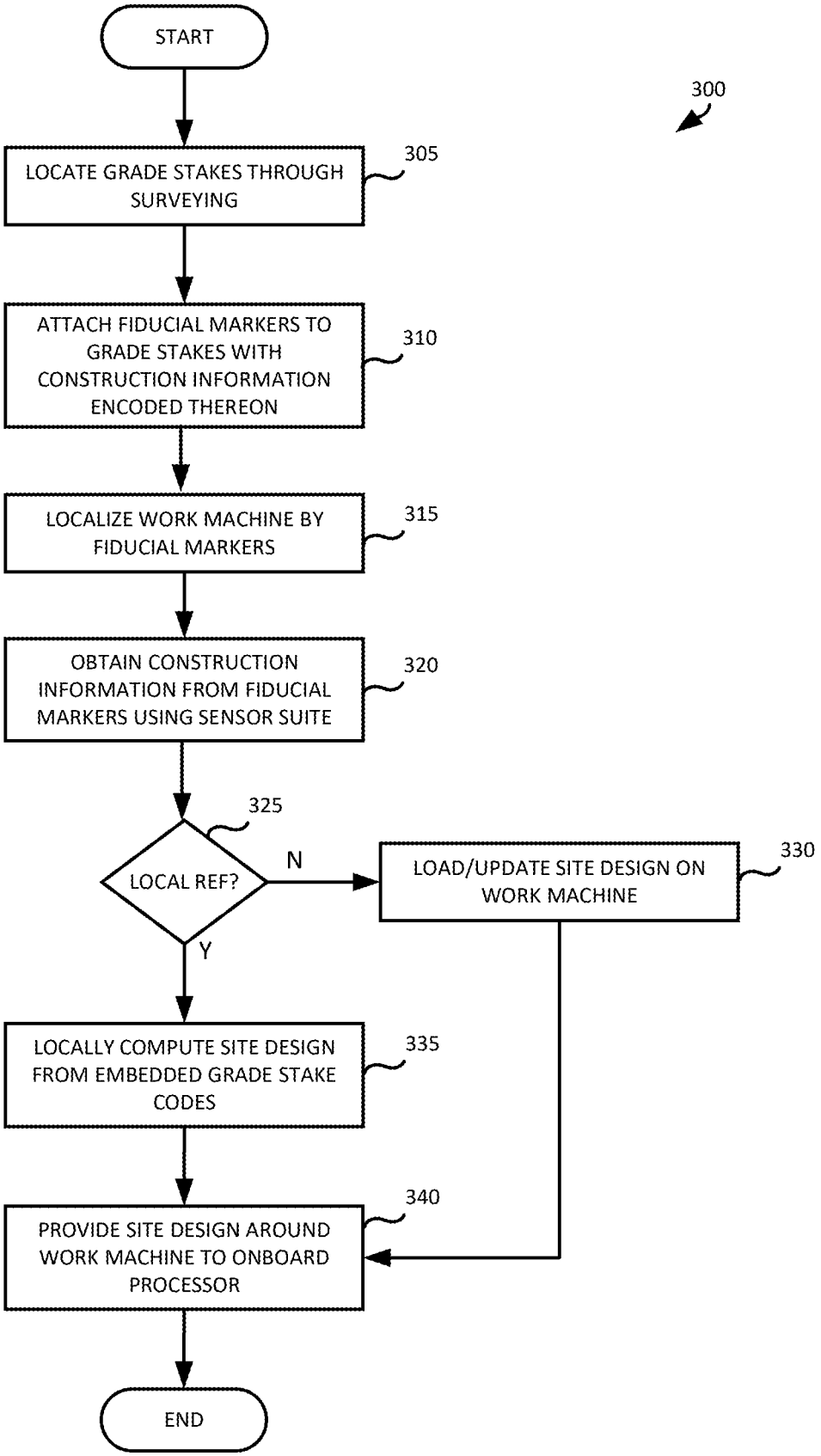
FIG. 3 is a flowchart of an exemplary worksite stake out process by which the present inventive concept can be embodied.

FIG. 3 is a flowchart of an exemplary worksite stake out process 300 by which the present inventive concept can be embodied. In operation 305, grade stakes may be placed in the worksite according to a site plan. Embodiments of the present inventive concept may place the grade stakes according to human surveying, although such is not necessary to practice the inventive concept. Indeed, as discussed above, a work machine may compute a local site design that does not rely on grade stakes, at least from a local design perspective. This feature may be extended to larger regions to reduce the number of grade stakes needed to convey the design.

Process 300 may transition to operation 310 by which fiducial markers are attached to grade stakes, where the fiducial markers may have construction information encoded thereon. Process 300 may then transition to operation 315 by which the work machine localizes using the fiducial markers and, in operation 320, the construction information is obtained from the fiducial markers by the sensor suite. Process 300 may transition to operation 325 by which it is determined whether a local site plan, as opposed to a global site plan, is selected. If not, a global site design is loaded from offboard memory onto the work machine in operation 330. If, however, a locally referenced site plan is selected, a local site plan is computed onboard the work machine in operation 335 using the construction information encoded on the grade states. For both the selection of global and local site plans, operation 340 may provide the relevant site design to memory onboard the work machine.

Figure 4:
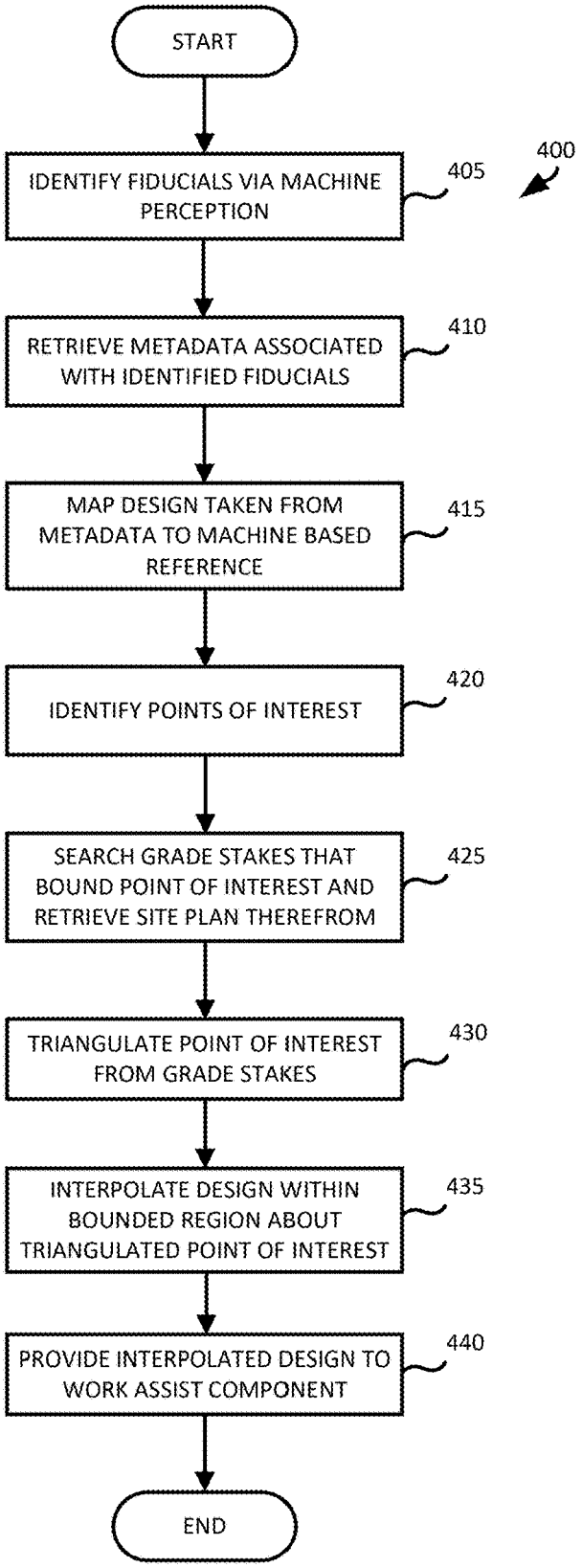
FIG. 4 is a flowchart of an exemplary local site plan generation process by which the present inventive concept can be embodied.

FIG. 4 is a flowchart of an exemplary local site plan generation process 400 by which the present inventive concept can be embodied. At operation 405, process 400 identifies fiducial markers via machine perception and, in operation 410, the metadata associated with the identified fiducial markers are retrieved. When AprilTags are used, for example, the metadata may be encoded on the fiducial markers themselves. Other implementations are possible, including those that retrieve the metadata from an offboard repository or database. In operation 415, the site plan design may be mapped from offboard coordinates to local coordinates defined by the work machine frame. Process 400 may transition to operation 420, whereby a point of interest, such as the distal end of a work tool or a section thereof, such as an excavator bucket or another location on the work machine, may be identified. The present inventive concept may be realized to use any point of interest selected by the machine operator. In operation 425, grade stakes that bound the point of interest are sought and selected and the site plan, e.g., contained in the associated metadata, is retrieved therefrom. Process 400 may transition to operation 430 by which the point of interest is triangulated, for example, and in operation 435, the site design at the point of interest is interpolated within the bounded region from the triangulating grade stakes. In operation 440, the interpolated design information is provided to a work assist component for executing the interpolated design information at the point of interest.

Figure 5:
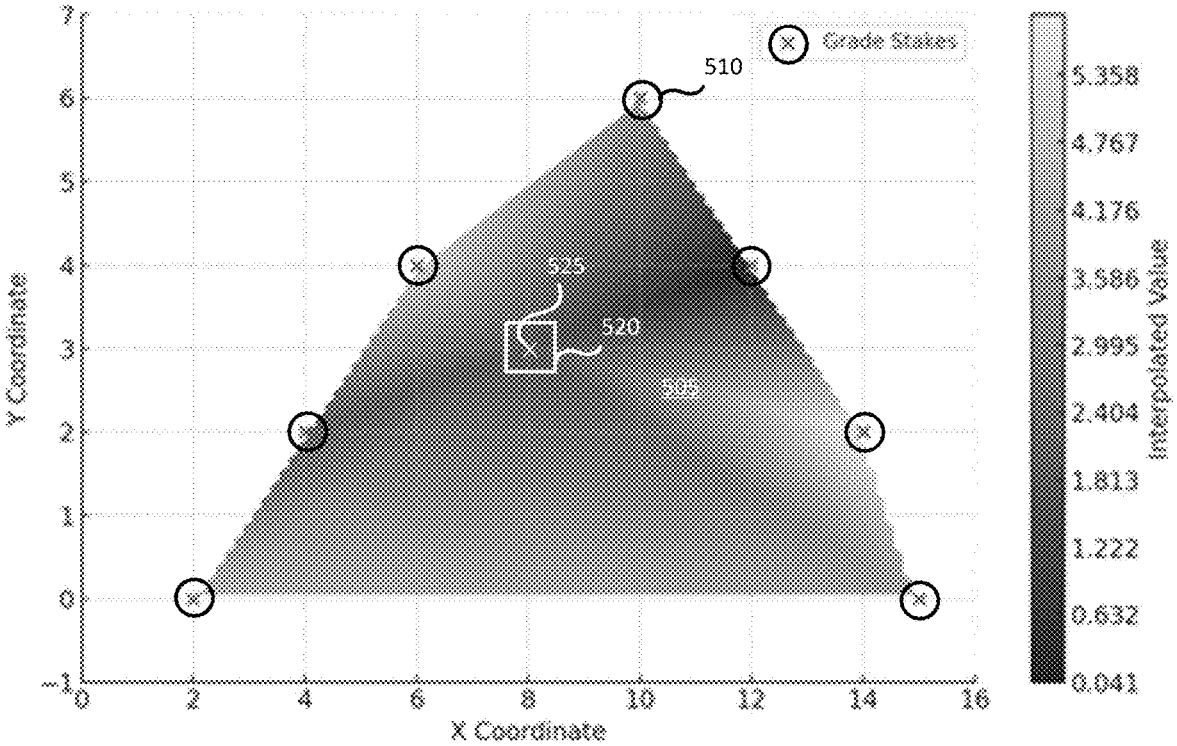
FIG. 5 is a graph of a location of a point of interest relative to certain grade stakes and a local site plan at the designated point of interest.

FIG. 5 is a graph of a location of a point of interest 525 relative to certain grade stakes, representatively illustrated at grade stake 510, and a local site plan 520 at the designated point of interest 525. As illustrated, grade stakes 510 define a bounded region 505 at which site plan information may be retrieved as described above. The point of interest 525 is located in the bounded region 505 as determined by, for example, triangulation, about which is formed a local site plan 520. The construction operation at the point of interest 525 may be interpolated from the construction operation data conveyed by fiducial marker on grade stakes 510.

Certain embodiments of the present general inventive concept provide for the functional components to manufactured, transported, marketed and/or sold as processor instructions encoded on computer-readable media. The present general inventive concept, when so embodied, can be practiced regardless of the processing platform on which the processor instructions are executed and regardless of the manner by which the processor instructions are encoded on the computer-readable medium.

It is to be understood that the computer-readable medium described above may be any non-transitory medium on which the instructions may be encoded and then subsequently retrieved, decoded and executed by a processor, including electrical, magnetic and optical storage devices. Examples of non-transitory computer-readable recording media include, but not limited to, read-only memory (ROM), random-access memory (RAM), and other electrical storage; CD-ROM, DVD, and other optical storage; and magnetic tape, floppy disks, hard disks and other magnetic storage. The processor instructions may be derived from algorithmic constructions in various programming languages that realize the present general inventive concept as exemplified by the embodiments described above.

INDUSTRIAL APPLICABILITY

Performing construction operations of a worksite may rely heavily on a staked-out site design. Even then, a work machine performing an excavator cut operation, for example, may cut deeper than what is prescribed by a grade stake. Accordingly, the overcut region must be backfilled which takes time away from other construction operations. Thus, the construction industry seeks more accurate construction and worksite plan design information to provide to the work machine and its operator. Additionally, the present inventive concept provides mechanisms by which machine operations are controlled for more precise construction operations.

The descriptions above are intended to illustrate possible implementations of the present inventive concept and are not restrictive. Many variations, modifications and alternatives will become apparent to the skilled artisan upon review of this disclosure. For example, components equivalent to those shown and described may be substituted therefore, elements and methods individually described may be combined, and elements described as discrete may be distributed across many components. The scope of the invention should therefore be determined not with reference to the description above, but with reference to the appended claims, along with their full range of equivalents.

What is claimed is:

1. A system constructed to stakeout a worksite according to a site plan, the system comprising:

a set of fiducial markers, each being associated with a construction operation performed at the worksite, wherein each of the set of fiducial markers are attached to a respective grade stake distributed over the worksite, and wherein construction operation data corresponding to a location of the respective grade stake is encoded on each of the set of fiducial markers;

a set of sensors of diverse sensory modalities, the set of sensors generating respective signals from which information associated with the construction operation is conveyed, wherein the information associated with the construction operation includes the construction operation data encoded on at least one fiducial marker of the set of fiducial markers; and a processor constructed to:

based at least in part on the construction operation data, ascertain from the respective signals:

a location of a work machine at the worksite, wherein the location of the work machine includes a point of interest associated with a work tool of the work machine, and the construction operation; and determine the location of the work machine in the site plan is bounded by the location of the respective grade stake of the at least one fiducial marker; and constrain an operator control functionality of the work machine to the construction operation according to the location of the work machine in the site plan.

2. The system of claim 1, wherein the set of fiducial markers are distributed over the worksite according to the site plan.

3. The system of claim 2, wherein the construction operation associated with each of the set of fiducial markers on the respective grade stake includes cut, fill and slope excavation operations.

4. The system of claim 3, wherein the processor is further constructed to generate, as the site plan, a local site plan that refers to a selected location on the worksite.

5. The system of claim 4, wherein the processor is further constructed to determine the construction operation at the selected location by interpolating the construction operation at the respective grade stake bounding the selected location on the worksite.

6. The system of claim 5, wherein the processor is further constructed to generate a modified local site plan that alters the construction operation at the selected location beyond the interpolated construction operation.

7. The system of claim 3, wherein the processor is further constructed to retrieve a global site plan as the site plan that refers to a global control point.

8. The system of claim 1, wherein the set of fiducial markers are emissive in a spectrum other than a visible light spectrum to which a sensor from among the set of sensors is responsive.

9. An apparatus constructed to stakeout a worksite, the apparatus comprising:

a set of diverse sensors each constructed to generate respective signals from which information associated with a construction operation is conveyed from fiducial markers distributed over the worksite, wherein the information associated with the construction operation includes construction operation data encoded on at least one fiducial marker of a set of fiducial markers, and wherein each of the set of fiducial markers are attached to a respective grade stake distributed over the worksite, and wherein the construction operation data corresponding to a location of the respective grade stake is encoded on each of the set of fiducial markers; and a processor constructed to:

generate a site plan in which a selected location on the worksite is defined;

based at least in part on the construction operation data, interpolate the construction operation conveyed by the respective signals that bound the selected location on the worksite;

constrain an operator control functionality of a work machine in performing the interpolated construction operation at the selected location.

10. The apparatus of claim 9, wherein the processor is further constructed to generate a modified local site plan that alters the construction operation at the selected location beyond the interpolated construction operation.

11. The apparatus of claim 9, wherein the fiducial markers are distributed over the worksite according to the site plan.

12. The apparatus of claim 9, wherein the construction operation associated with the fiducial markers on the grade stakes include cut, fill and slope excavation operations.

13. The apparatus of claim 9, wherein the fiducial markers are emissive in a spectrum other than a visible light spectrum to which a sensor from among the set of diverse sensors is responsive.

14. A method for stakeout of a worksite comprising:

distributing a set of fiducial markers over the worksite according to a site plan, each of the set of fiducial markers being associated with respective construction operations performed at the worksite, wherein each of the set of fiducial markers are attached to a respective grade stake distributed over the worksite, and wherein construction operation data corresponding to a location of the respective grade stake is encoded on each of the set of fiducial markers;

based at least in part on the construction operation data, ascertaining, from signals generated by a set of diverse sensors responsive to at least one of the set of fiducial markers, a location of a work machine at the worksite and a corresponding construction operation from among the respective construction operations performed thereat; and constraining an operator control functionality of the work machine to the corresponding construction operation according to the location of the work machine in the site plan.

15. The method of claim 14, wherein the respective construction operation associated with the fiducial markers on the grade stakes include cut, fill and slope excavation operations.

16. The method of claim 14, further comprising generating, as the site plan, a local site plan that includes a selected location on the worksite.

17. The method of claim 16, further comprising interpolating respective construction operations at grade stakes bounding the selected location on the worksite to determine the corresponding construction operation at the selected location.

18. The method of claim 17, further comprising generating a modified local site plan that alters the corresponding construction operation at the selected location beyond the interpolated construction operations.

* * * * *